US006740477B2

(12) United States Patent
Schmittou et al.

(10) Patent No.: US 6,740,477 B2
(45) **Date of Patent: *May 25, 2004**

(54) METHOD TO REDUCE CORROSIVITY OF PHOTOGRAPHIC PROCESSING EFFLUENT

(75) Inventors: Eric R. Schmittou, Rochester, NY (US); Cynthia A. Salsedo, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/436,183

(22) Filed: May 12, 2003

(65) Prior Publication Data

US 2003/0194661 A1 Oct. 16, 2003

Related U.S. Application Data

(62) Division of application No. 10/021,703, filed on Oct. 30, 2001, now Pat. No. 6,579,669.

(51) Int. Cl.[7] ..... G03C 7/44
(52) U.S. Cl. ..... 430/398; 430/403
(58) Field of Search ..... 430/398, 403

(56) References Cited

U.S. PATENT DOCUMENTS 3,923,511 A * 12/1975 Bissonette ..... 430/367
5,605,786 A 2/1997 Saito et al. ..... 430/553
5,961,939 A 10/1999 Kulp et al.
6,136,518 A 10/2000 Buongiorne et al. ..... 430/486
6,387,243 B1 * 5/2002 Gasser ..... 205/687
6,541,190 B1 * 4/2003 Haye et al. ..... 430/455

FOREIGN PATENT DOCUMENTS

| | | |
|---|---|---|
| DE | 2 009 826 | 1/1972 |
| EP | 0 243 168 | 10/1987 |
| EP | 0 270 382 | 6/1988 |
| EP | 0 358 037 | 3/1990 |
| WO | WO 01/50197 | 7/2001 |

OTHER PUBLICATIONS

U.S. application Ser. No. 09/705,542 filed Nov. 3, 1000 "Apparently Day Wast Management System".
U.S. application Ser No. 10/012,673 filed Oct. 30, 2001 "Processing Photographic Material".

* cited by examiner

*Primary Examiner*—Hoa Van Le
(74) *Attorney, Agent, or Firm*—Sarah Meeks Roberts

(57) ABSTRACT

This relates to a method of rendering a used photographic processing solution less corrosive to low carbon steel comprising:

taking at least a used photographic processing solution containing a color developing agent and a used photographic processing solution containing a bleaching agent;

delivering the used photographic processing solutions to a collection vessel to form a used photographic processing composition; and adjusting the pH of the used photographic processing composition to 6.5 to 11.

8 Claims, No Drawings

METHOD TO REDUCE CORROSIVITY OF PHOTOGRAPHIC PROCESSING EFFLUENT

CROSS REFERENCE TO RELATED APLICATIONS

This is a Divisional of application Ser. No. 10/021,703 filed Oct. 30, 2001 now U.S. Pat. No. 6,579,669.

FIELD OF THE INVENTION

The present invention relates generally to processing methods for silver halide photographic elements, and more particularly to a method of reducing the corrosion characteristics of the photographic effluent waste generated by the processing method and processor.

BACKGROUND OF THE INVENTION

Color photographic processing typically includes the processing steps of development, bleaching, fixing, washing, and stabilizing. For color negative materials these steps are practiced using a color developer that generates the dye image and, as a side product, metallic silver; a bleach containing a heavy metal bleaching agent that converts any metallic silver into silver ion, and a fixing solution containing a fixing agent that forms soluble silver ion complexes which are removed in the fixing and subsequent washing or stabilizing steps. Finally, the photographic element may be processed in a stabilization step that renders the material stable for storage and includes agents, such as surfactants, that allow water to sheet off the surface without streaking.

With the move toward digital or hybrid technologies, it is becoming increasingly undesirable in the photofinishing trade to manage photographic chemistries and their associated effluents, including managing effluents to on-site drains and local sewer systems. It is becoming more desirable to develop convenient and cost-effective mechanisms to collect photographic effluents in containers for shipment off site. Photoprocessing effluent that is characterized as corrosive (as defined by US waste management regulations) cannot be managed on-site for disposal. Further, waste mixtures that are corrosive may not be transported off site without adhering to stringent US regulatory requirements that may include special labeling and handling procedures. In addition, licensed haulers must be used to manage corrosive wastes off site, presenting an additional cost burden to the photofinisher. Therefore, it is advantageous in handling, transporting, and disposing of photographic effluents and their containers for the effluents not to be corrosive (as defined by US waste management regulations).

The Corrosion characteristic of concern for the safe collection and transportation of photographic waste effluent is the corrosion of UNS G10200 low carbon steel in contact with the waste effluent. This corrosion test protocol is EPA method 1110A. According to the U.S. Resource Conservation and Recovery Act (RCRA), a chemical waste is considered corrosive and, therefore, hazardous, if its low carbon steel corrosion rate is greater than 6.35 mm/yr, when tested by EPA method 1110A. RCRA also specifies that the waste solution would be corrosive if its pH is less than 2.0 or greater than 12.5.

Waste photographic processing solutions may consist of individual used solutions or mixtures of two or more of the following used processing solutions collected in containers: developers, conditioners, bleaches, bleach accelerators or pre-bleaches, fixers, bleach-fixers, stabilizers, rinses, and low-flow washes. Some used processing solutions themselves are quite corrosive, such as photographic bleaches and bleach-fixers which contain oxidizing agents. Photographic developers are highly alkaline solutions and may have toxic characteristics that may make them hazardous. Therefore, photographic bleach waste and photographic developer waste cannot be conveniently or cost effectively transported in their own containers because they are corrosive or may have toxic characteristics.

SUMMARY OF THE INVENTION

This invention provides a method of rendering a used photographic processing solution less corrosive to low carbon steel comprising:

taking at least a used photographic processing solution containing a color developing agent and a used photographic processing solution containing a bleaching agent;

delivering the used photographic processing solutions to a collection vessel to form a used photographic processing composition, and adjusting the pH of the used photographic processing composition to 6.5 to 11. In one embodiment the pH is adjusted by manipulating the proportions of the used processing solutions. In another embodiment the pH is adjusted by treating the used photographic processing composition with a chemical acid or base.

This invention further provides a method of photographic processing and management of photographic processing solutions comprising:

A) color developing an imagewise exposed color photographic silver halide material with an aqueous color developing composition comprising a color developing agent, B) without removing said color photographic silver halide material from said aqueous color developing composition, contacting said color photographic silver halide material with a photographic fixing composition comprising a photographic fixing agent, thereby forming a combined color development/fixing processing composition, C) without removing said color photographic silver halide material from said combined color development/fixing processing composition, contacting said color photographic silver halide material with a photographic bleaching composition, thereby forming a combined color development/fixing/bleaching processing composition, and D) delivering the combined color development/fixing/bleaching processing composition to a collection vessel to form a used photographic processing composition. In one embodiment the combined color development/fixing/bleaching processing composition has a pH of 6.5 to 11. In another embodiment the combined color development/fixing/bleaching processing composition or the used photographic processing composition is treated with a chemical acid or base to adjust the pH to 6.5 to 11.

This invention provides a way to render used bleach solution and other used photographic processing solutions safe and convenient to handle as photographic waste. The photographic effluent generated by the processor, because it is non-corrosive according to this invention, may be suitable for sewering on-site after any necessary silver recovery operations have been performed. In a preferred embodiment of the invention the effluent is collected in or near the processor and transported off site for recovery of silver and disposal as a non-hazardous waste, thus reducing transportation costs and paperwork requirements to the waste generator.

DETAILED DESCRIPTION OF THE INVENTION

It has been found by the inventors herein that used photographic processing compositions, consisting of a mixture of used photographic bleach or bleach-fixer solution and used photographic color developer solution, are non-corrosive according to the RCRA regulations if the mixture pH has a value of 6.5 or higher, more preferably a value of 7.0 or higher, and most preferably a pH of 7.5 or higher. The used processing composition pH should not be higher than about 9 if it contains ammonium salts to avoid the release of ammonia vapor from the composition. Preferably the pH should be less than about 8.5 to avoid ammonia vapor release and most preferably, the pH should be less than about 8 if ammonium salts are present. The mixture of used photographic color developer solution and used photographic bleach or bleach-fixer solution may also contain used photographic fixer solutions, and used photographic wash or rinse solutions from the photographic process. The pH of such mixtures should also be greater than about 6.5 in order for the mixture not to be corrosive.

In one embodiment of the current invention a used photographic processing solution containing a color developing agent and a used photographic processing solution containing a bleaching agent are delivered to a collection vessel forming a used photographic processing composition within the vessel. The solutions may be delivered separately to the collection vessel or they may be combined prior to delivery to the collection vessel and the invention is intended to include both of these methods. They may be delivered sequentially or simultaneously. The used photographic processing composition is adjusted to a pH of about 6.5 to 110. The phrase "adjusting the pH of the used photographic processing composition" includes adjusting the pH of the processing solutions prior to delivery to the collection vessel or after delivery to the collection vessel. It includes adjusting the pH of the used photographic processing composition merely by manipulating the amount of the various used processing solutions which are delivered to the collection vessel and/or by treating the used processing solutions or the used processing composition by some chemical means to adjust the pH. Such chemical treatment may take place before or after delivery of the used processing solutions to the collection vessel, preferably after delivery. The processing solutions or their mixtures may be treated with acids, bases, buffers, or silver precipitating agents prior to delivery to the collection vessel, or the used photographic processing composition may be treated with acids, bases, buffers, or silver precipitating agents in the collection vessel. The collection vessel may contain the means of chemical treatment prior to delivery of the used processing solutions, or such chemical agents may be added after the solutions have been combined in the collection vessel. "Adjusting the pH of the used photographic processing composition" includes any of the above methods utilized to arrive at a final used photographic processing composition having a pH of 6.5 to 11.0. Preferably the used processing composition is adjusted to a pH of about 7.0 to 11.0, and most preferably to a pH of about 7.5 to 11.0. Given the composition of the solutions, it may be preferable to adjust the pH to below 9.0, preferably below 8.5, and most preferably below 8.0.

Through the design of the processing solution formulations and the amounts of each solution that become part of the waste mixture, it is possible to control the pH of the final used photographic processing composition so that minimal chemical treatment is necessary. For example, the acidity and low pH of the used bleach or bleach-fixer solution is neutralized by combining it with the used alkaline developer solution which has a higher pH and greater alkalinity than the bleach or bleach-fixer solution. The proper balance of solution amounts and acid-base control can be found by one skilled in the art to achieve the necessary final pH.

The acids, bases, or buffers which may be used to modify the pH of the used processing solutions or their mixtures, before or after they are delivered to the collection vessel, include solid or liquid acids, bases, and buffers which may be dissolved in aqueous solutions. Such acids include carboxylic acids such as acetic, glycolic, succinic, phthalic, lactic, maleic, malonic, glutaric, malic, tartaric, gluconic, sulfosuccinic, and citric acids; sulfamic, sulfuric, and phosphoric acids; and hydrogensulfate, hydrogensulfite, and metabisulfite salts. Bases include organic bases such as imidazole, guanidine, diethanolamine, triethanol amine, ethanol amine, and tris(hydroxylmethyl)aminomethane (TRIS); inorganic bases such as carbonate, bicarbonate, phosphate, borate, sulfite, and hydroxide salts of sodium, potassium, lithium, magnesium, and calcium. Buffers include mixtures of the above acids and bases with their salts; aminoacids and their salts, such as glycine, lysine, aspartic acid, glutamic acid, arginine; aminosulfonic acids and their salts, such as N-(2-hydroxyethyl)piperazine-N'-(2-ethanesulfonic acid) (HEPES). Particularly preferred acids, bases, and buffers are glycolic acid, succinic acid, sulfosuccinic acid, and phthalic acid and their salts, hydrogensulfate, hydrogensulfite, and metabisulfite salts, imidazole, carbonate, bicarbonate, sulfite, and phosphate salts.

In one embodiment of the invention a used photographic processing solution containing a photographic fixing agent is delivered to the collection vessel. This solution may be either a fixer solution or a bleach/fixer solution. The used photographic processing solution containing a photographic fixing agent may be added sequentially or simultaneously with the other processing solutions, or it may be combined with both or either of the used photographic processing solution containing a color developing agent and the used photographic processing solution containing a bleaching agent prior to delivery to the collection vessel. It may be used to adjust the pH of the used photographic processing composition as discussed above for the processing solutions containing the developing agent and the bleaching agent. Other used processing solutions may also be delivered to the collection vessel, such as stabilizers, stop baths, and washes.

When the used photographic processing solutions contain dissolved silver, such as used fixer or bleach-fixer solutions, or post-fixer or post bleach-fixer rinses, or low-flow washes, it is preferred that the used processing solutions or the used processing composition be treated with a material to precipitate the dissolved silver. Nonlimiting examples include steel wool, metal sulfide salts, or metal hydrogensulfide salts; a wide variety of alkyl, aryl, and heterocyclic thiol compounds, including mercaptoazoles such as 5-mercaptotetrazoles, mercaptoazines such as mercaptopyridines, mercaptopyrazines, mercaptopyridazines, mercaptopyrimidines; N-substituted dithiocarbamate salts; O-substituted xanthate salts; tetraazaindenes; and purines. One particularly useful class of precipitating agents are derived from mercapto-s-triazine or water-soluble salts thereof. The mercapto-s-triazine compound has the formula Formula I

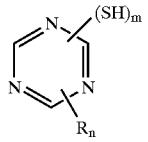

wherein:

R is hydrogen, —$NH_4$, —OH, an alkyl having 1 to 8 carbon atoms, an alkoxy having 1–8 carbon atoms, phenyl, cyclohexyl, ocxazinyl, phenoxy, —$NR'_2$ or —SR". R' is hydrogen, an alkyl having 1 to 8 carbon atoms, phenyl, cyclohexyl, naphthyl or benzyl. R" is an alkyl having 1 to 8 carbon atoms, phenyl, cyclohexyl, naphthyl, or benzyl. m is an integer from 1 to 3 and n is an integer from 0 to 2. The sum of n+m is 1, 2, or 3. A preferred embodiment is trimercapto-s-triazine (TMT) which is sold by Degussa under the tradename "TMT-15". In one preferred embodiment the silver precipitating agent is dissolved in solution, the alkaline nature of which serves to raise the pH of the used photographic processing solutions or their mixtures or of the final used processing composition.

The used processing solutions may be generated by any conventional photographic processor known in the trade for processing silver halide-based photographic materials. More particularly, the processor is used for processing silver halide-based color photographic materials. Such processors include large multi-tank, multi-lane replenished processing machines such as those used by large wholesale photofinishers. Also included are multi-tank minilab processors or microlab processors, used by smaller-scale photofinishing operations such as those found in drug stores, grocery stores, and small photo shops.

The used processing solutions may be generated by less conventional processors such as those described in U.S. Pat. Nos. 5,864,729; 5,890,028, or 5,960,227; a drum processor such as the Kodak RS-11 Drum Processor; or the wave processor described in U.S. application Ser. No. 09/920,495, filed Aug. 1, 2001, the disclosure of which is incorporated herein by reference. This is a small processor that uses small volumes of processing solutions once to process photographic material. It processes the material with only a few millilitres of processing solution which is then collected as waste. This processor processes a photographic material by loading the material into a chamber, introducing a metered amount of processing solution into the chamber, and rotating the chamber in a fashion which forms a wave in the solution through which the material passes. The appropriate solution for each processing stage is added and removed sequentially from the processing space and can be managed for disposal as described in the current invention.

Another processor and processing method with which the current invention is particularly useful is the merged process described in U.S. Pat. No. 6,620,578, the disclosure of which is incorporated herein by reference. This processing method for silver halide photographic material comprises loading the material into a chamber, introducing a metered amount of a first processing solution into the chamber, and processing the photographic material with the first processing solution. It then comprises introducing a metered amount of a second processing solution into the chamber without removing the first processing solution so that at least part of the whole volume of the second processing solution is provided by the first processing solution and processing the photographic material with the second processing solution. The merged method further comprises, after processing the photographic material with the second processing solution, introducing a metered amount of a third processing solution into the chamber without removing any processing solution remaining from the preceding processing solution or solutions so that at least part of the total volume of the third processing solution is provided by the preceding processing solution or solutions and processing the photographic material with the third processing solution.

Using the merged solution processing method it is possible to add all of the processing solutions except the wash solution on top of one another in the correct sequence without removing the previous solution. Thus, the whole of the previous solution is mixed with the next solution. The method is preferably carried out in a high agitation single-use processor which processes one film at a time with small volumes similar to those used to replenish continuous processors with tanks of several liters. Thus, a developer solution may be added to the tank of the single-use processor, and after development is complete, a bleach solution, for example, is added to the developer solution to transform the developer into a bleach solution, then a fix solution is added to the developer plus bleach solution to convert it into a bleach-fix solution. The previous solution acts as a diluent for the next solution which means that the next solution can be more concentrated than it would be if it were used alone. This means that the total volume used in the process can be less than that used if each solution is removed after the particular stage it performs is complete.

One preferred embodiment of the current invention is a merged method of photographic processing and management of photographic processing solutions comprising:

A) color developing an imagewise exposed color photographic silver halide material with an aqueous color developing composition comprising a color developing agent, B) without removing said color photographic silver halide material from said aqueous color developing composition, contacting said color photographic silver halide material with a photographic fixing composition comprising a photographic fixing agent, thereby forming a combined color development/fixing processing composition, C) without removing said color photographic silver halide material from said combined color development/fixing processing composition, contacting said color photographic silver halide material with a photographic bleaching composition, thereby forming a combined color development/fixing/bleaching processing composition, and D) delivering the combined color development/fixing/bleaching processing composition to a collection vessel to form a used photographic processing composition.

Preferably the pH of the combined color development/fixing/bleaching processing composition is 6.5 to 11.0. More preferably the pH of the combined color development/fixing/bleaching processing composition is 6.5 to 9.0. Given the composition of the solutions, it may be preferable to adjust the pH to below 9.0, preferably below 8.5, and most preferably below 8.0. Preferably the pH of the combined color development/fixing/bleaching processing composition is adjusted to at least 7.0, and more preferably to at least 7.5.

The development/fixing/bleaching processing composition may be pH adjusted merely by manipulating the amount of the various processing compositions which are combined to form the combined color development/fixing/bleaching processing composition. Alternatively, a chemical treatment may be used to adjust the pH of either the combined color development/fixing/bleaching processing composition or the used photographic processing composition to 6.5 to 11, i.e., the combined color development/fixing/bleaching processing composition may be pH adjusted before or after delivery to the collection vessel. Preferably any treatment to adjust pH is made after delivery to the collection vessel. Suitable treatments are the same as those discussed above. When appropriate the combined color development/fixing/bleaching processing composition and/or the used photographic processing composition are treated with a silver precipitating agent as discussed above.

Examples that demonstrate this invention use color negative film processing solutions but are not meant to limit this application to color negative film processing solutions. Other photographic materials and processing systems are described in:

*Research Disclosure*, September 1994, Item 36544, Sections XV to XX which describes supports, exposure, development systems and processing methods and agents and in

*Research Disclosure*, February 1995, Item 37038 which describes certain desirable photographic elements and processing steps, particularly those useful in conjunction with color reflective prints.

Photographic color developing compositions, the used solutions of which may be disposed of pursuant to this invention, typically include one or more color developing agents and various other conventional addenda including preservatives or antioxidants (including sulfites, and hydroxylamine and its derivatives), sulfites, metal ion sequestering agents, con-osion inhibitors, and buffers. These materials can be present in conventional amounts. For example, the color developing agent is generally present in an amount of at least 0.001 mol/l (preferably at least 0.01 mol/l), and an antioxidant or preservative for the color developing agent, if present, is generally present in an amount of at least 0.0001 mol/l (preferably at least 0.001 mol/l). The pH of the composition is generally from about 9 to about 13, and preferably from about 9.5 to 12.5.

Exemplary color developing compositions and components are described, for example, in EP-A-0 530 921 (Buongiorne et al), U.S. Pat. Nos. 5,037,725 (Cullinan et al); 5,552,264 (Cullinan et al); 5,508,155 (Marrese et al); 4,892,804 (Vincent et al); 4,482,626 (Twist et al); 4,414,307 (Kapecki et al); 4,876,174 (Ishikawa et al); 5,354,646 (Kobayashi et al), and 4,264,716 (Vincent et al), U.S. application Ser. No. 09/706,006 of Arcus et al, U.S. application Ser. No. 09/706,463 of Haye et al, and U.S. application Ser. No. 09/706,474 of Arcus et al, all filed Nov. 3, 2000, all incorporated herein for their teaching about color developing compositions.

Useful preservatives in the color developing compositions include sulfites (such as sodium sulfite, potassium sulfite, sodium bisulfite and potassium metabisulfite), hydroxylamine and its derivatives, especially those derivatives having substituted or unsubstituted alkyl or aryl groups, hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. More particularly useful hydroxylamine derivatives include substituted and unsubstituted monoalkyl- and dialkylhydroxylamines (especially those substituted with sulfo, carboxy, phosphono, hydroxy, carbonamido, sulfonamido or other solubilizing groups). Mixtures of compounds from the same or different classes of antioxidants can also be used if desired.

Examples of useful antioxidants are described for example, in U.S. Pat. Nos. 4,892,804 (noted above), 4,876,174 (noted above), 5,354,646 (noted above), 5,660,974 (Marrese et al), and 5,646,327 (Burns et al), the disclosures of which are all incorporated herein by reference for description of useful antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

Most preferably, the noted hydroxylamine derivatives can be mono- or dialkylhydroxylamines having one or more hydroxy substituents on the one or more alkyl groups. Representative compounds of this type are described, for example, in U.S. Pat. No. 5,709,982 (Marrese et al), incorporated herein by reference. Specific di-substituted hydroxylamine antioxidants include, but are not limited to, N,N-bis(2,3-dihydroxypropyl)hydroxylamine, N,N-bis(2-methyl-2,3-dihydroxypropyl)hydroxylamine, and N,N-bis(1-hydroxymethyl-2-hydroxy-3-phenylpropyl)hydroxylamine. The first compound is preferred.

Particularly useful color developing agents include aminophenols, p-phenylenediamines (especially N,N-dialkyl-p-phenylenediamines), and others which are well known in the art, such as EP 0 434 097 A1 (published Jun. 26, 1991) and EP 0 530 921 A1 (published Mar. 10, 1993). Preferred color developing agents include, but are not limited to, N,N diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

Photographic bleaching compositions, the waste solutions of which may be disposed of pursuant to this invention, generally include one or more persulfate, periodate, peracid (such as hydrogen peroxide, periodates, or percarbonates) or high-valent metal ion bleaching agents, such as iron(III) salts with simple anions (such as nitrate, sulfate, and acetate), or iron(III) complexes with carboxylic acid or phosphonic acid ligands. Particularly useful bleaching agents include iron(III) complexes of one or more aminocarboxylic acids, aminopolycarboxylic acids, polyaminocarboxylic acids or polyaminopolycarboxylic acids, or salts thereof. Particularly useful chelating ligands include conventional polyaminopolycarboxylic acids including ethylenediaminetetraacetic acid (EDTA), 1,3-propylenediaminetetraacetic acid (PDTA) and others described in Research Disclosure, noted above, U.S. Pat. Nos. 5,582,958 (Buchanan et al) and 5,753,423 (Buongiorne et al). Biodegradable chelating ligands are also desirable because the impact on the environment is reduced. Useful biodegradable chelating ligands include, but are not limited to, 2,6-pyridinedicarboxylic acid (PDCA), beta-alaninediacetic acid (ADA), nitrilotriacetic acid (NTA), iminodiacetic acid or an alkyliminodiacetic acid (such as methyliminodiacetic acid (MIDA)), ethylenediaminedisuccinic acid (EDDS, particularly the S;S-isomer), and similar compounds as described in EP-A-0 532 003, and ethylenediamine monosuccinic acid (EDMS), and similar compounds as described in U.S. Pat. No. 5,691,120 (Wilson et al), all of which are incorporated herein by reference in relation to their description of bleaching agents. The most preferred bleaching agent is a ferric ion complex of EDTA for processing color paper materials with a bleach/fixing composition. For processing color negative film materials a ferric complex of PDTA is preferred. Bleaching agents and compositions may be combined with fixing agents and compositions to form bleach-fixing compositions. When using bleaching compositions in single-use processing methods, strong oxidizing agents such as Fe(III)PDTA or Fe(III) $(MIDA)_2$, can be used in combination with fixing agents to form single-use bleach-fixing compositions, as described in U.S. application Ser. No. 09/705,404 filed Nov. 3, 2000. Multiple bleaching agents can be present if desired.

These and many other such complexing ligands known in the art including those described in U.S. Pat. Nos. 4,839,262 (Schwartz), 4,921,779 (Cullinan et al), 5,037,725 (noted above), 5,061,608 (Foster et al), 5,334,491 (Foster et al), 5,523,195 (Darmon et al), 5,582,958 (Buchanan et al), 5,552,264 (noted above), 5,652,087 (Craver et al), 5,928,844 (Feeney et al), 5,652,085 (Wilson et al), 5,693,456 (Foster et al), 5,834,170 (Craver et al), and 5,585,226 (Strickland et al), all incorporated herein by reference for their teaching of bleaching compositions. The total amount of bleaching agent(s) in the composition is generally at least 0.05 mol/l, and preferably at least 0.1 mol/l. These amounts would apply to bleach-fixing compositions also.

Other components of the bleaching solution include buffers, halides, corrosion inhibiting agents, and metal ion sequestering agents. These and other components and conventional amounts are described in the references in the preceding paragraph. The pH of the bleaching composition is generally from about 3 to about 7.0, and preferably 3.5 to 6.5.

Fixing solutions, the silver bearing waste solutions of which may be disposed of pursuant to this invention, contain a photographic fixing agent. Examples of photographic fixing agents include, but are not limited to, thiosulfates (for example, sodium thiosulfate, potassium thiosulfate, and ammonium thiosulfate), thiocyanates (for example, sodium thiocyanate, potassium thiocyanate, and ammonium thiocyanate), thioethers (such as ethylenebisthioglycolic acid and 3,6-dithia-1,8-octanediol), imides, and thiourea. Thiosulfates and thiocyanates are preferred, and thiosulfates are more preferred. Ammonium thiosulfate is most preferred. The general amount of total fixing agents in the fixing composition of this invention is at least 0.001 mol/l, and preferably at least 0.1 mol/l. These amounts would apply to bleach-fixing compositions also.

It is also known to use fixing accelerators in fixing compositions. Representative fixing accelerators include, but are not limited to, ammonium salts, guanidine, ethylenediamine and other amines, quaternary ammonium salts and other amine salts, thiourea, thioethers, thiols, and thiolates. Examples of useful thioether fixing accelerators are described in U.S. Pat. No. 5,633,124 (Schmittou et al), incorporated herein for the teaching of fixing compositions.

Fixing compositions generally contain one or more monovalent or divalent cations supplied by various salts used for various purposes (for example, salts of fixing agents). It is preferred that the cations be predominantly ammonium cations, that is, at least 50% of the total cations are ammonium ions. Such fixing compositions are generally known as "high ammonium" fixing compositions.

Fixing compositions can also include one or more of various addenda optionally but commonly used in such compositions for various purposes, including hardening agents, preservatives (such as sulfites or bisulfites), metal sequestering agents (such as polycarboxylic acids and organophosphonic acids), buffers, and fixing accelerators. The amounts of such addenda in the working strength compositions would be readily known to one skilled in the art.

The desired pH of fixing compositions is generally less than 8 or greater than 4, and can be achieved and maintained using any useful combination of acids and bases, as well as various buffers.

Other details of fixing compositions not explicitly described herein are considered well known in the art and are described, for example, in Research Disclosure publication 38957 (noted below), and publications noted therein in paragraph XX(B), U.S. Pat. Nos. 5,424,176 (Schmittou et al), 4,839,262 (noted above), 4,921,779 (noted above), 5,037,725 (noted above), 5,523,195 (noted above), and 5,552,264 (noted above), all incorporated herein by reference for their teaching of fixing compositions.

Another photoprocessing composition which may result in a silver bearing waste solution is a dye stabilizing composition containing one or more photographic imaging dye stabilizing compounds. Such compositions can be used at the end of the processing sequence (such as for color negative films and color papers), or in another part of the processing sequence (such as between color development and bleaching as a pre-bleaching composition).

Such dye stabilizing compositions generally have a pH of from about 5.5 to about 8, and include a dye stabilization compound (such as an alkali metal formaldehyde bisulfite, hexamethylenetetramine, various benzaldehyde compounds, and various other formaldehyde releasing compounds), buffering agents, bleach-accelerating compounds, secondary amines, preservatives, and metal sequestering agents. All of these compounds and useful amounts are well known in the art, including U.S. Pat. Nos. 4,839,262 (noted above), 4,921,779 (noted above), 5,037,725 (noted above), 5,523,195 (noted above), and 5,552,264 (noted above), all incorporated herein by reference for their teaching of dye stabilizing compositions. Generally, one or more photographic dye stabilizing compounds are present in an amount of at least 0.0001 mol/l. A preferred dye-stabilizing composition includes sodium formaldehyde bisulfite as a dye stabilizing compound, and thioglycerol as a bleach-accelerating compound. More preferably, this composition is used as a pre-bleaching composition during the processing of color reversal photographic materials.

In some systems a dye stabilizing composition or final rinsing composition is used to clean the processed photographic material, as well as to stabilize the color image. Either type of composition generally includes one or more anionic, nonionic, cationic or amphoteric surfactants, and in the case of dye stabilizing compositions, one or more dye stabilizing compounds as described above. Particularly useful dye stabilizing compounds useful in these dye stabilizing compositions are described, for example, in EP-A 0 530 832 (Koma et al) and U.S. Pat. No. 5,968,716 (McGuckin et al). Other components and their amounts for both dye stabilizing and final rinsing compositions are described in U.S. Pat.

Nos. 5,952,158 (McGuckin et al), 3,545,970 (Giorgianni et al), 3,676,136 (Mowrey), 4,786,583 (Schwartz), 5,529,890 (McGuckin et al), 5,578,432 (McGuckin et al), 5,534,396, 5,645,980 (McGuckin et al), 5,667,948 (McGuckin et al), 5,750,322 (McGuckin et al), and 5,716,765 (McGuckin et al), all of which are incorporated by reference for their teaching of such compositions.

General and preferred concentrations of the compounds in various compositions are described in the table below. The endpoints of all ranges are considered approximate so that they should be interpreted as "about" the noted amounts.

| COMPOSITION | GENERAL (mol/l) | PREFERRED (mol/l) |
|---|---|---|
| Color Developing | 0.0001–0.5 | 0.001–0.4 |
| Pre-bleaching | 0.0001–0.1 | 0.001–0.05 |
| Bleaching | 0.05–0.75 | 0.1–0.5 |
| Fixing | 0.05–5.0 | 0.01–4.0 |
| Bleach-fixing | 0.05–5.0 | 0.01–4.0 |
| Dye Stabilizing | 0.0001–0.1 | 0.001–0.05 |
| Final Rinsing | 0.0001–0.01 | 0.001–0.005 |
| Washing solution | 0.00005–0.001 | 0.0001–0.001 |

Representative sequences for processing various color photographic materials are described, for example, in *Research Disclosure* publication 308119, December 1989, publication 17643, December 1978; and publication 38957, September 1996.

Silver halide photographic elements which are processed include color negative photographic films, color reversal photographic films, and color photographic papers. The general sequence of steps and conditions (times and temperatures) for processing are well known as Process C-41 and Process ECN-2 for color negative films, Process E-6 and Process K-14 for color reversal films, Process ECP for color prints, and Process RA-4 for color papers.

For example, color negative films that can be processed using the compositions described herein include, but are not limited to, KODAK MAX™ films, KODAK ROYAL GOLD™ films, KODAK GOLD™ films, KODAK PRO GOLD™ films, KODAK FUNTIME™, KODAK EKTAPRESS PLUS™ films, EASTMAN EXR™ films, KODAK ADVANTIX™ films, FUJI SUPERIA™ films, FUJI SMARTFILM™ products, FUJICOLOR NEXIA™ films, KONICA CENTURIA™ films, KONICA SRG3200 film, 3M SCOTCH™ ATG films, and AGFA HDC and XRS films. Films processed can also be those incorporated into what are known as "single-use cameras".

In addition, color papers that can be processed include, but are not limited to, KODAK EKTACOLOR EDGE V, VII, and VIII Color Papers (Eastman Kodak Company), KODAK ROYAL VII Color Papers (Eastman Kodak Company), KODAK PORTRA III, IIIM Color Papers (Eastman Kodak Company), KODAK SUPRA III and IIIM Color Papers (Eastman Kodak Company), KODAK ULTRA III Color Papers (Eastman Kodak Company), FUJI SUPER Color Papers (Fuji Photo Co., FA5, FA7, and FA9), FUJI CRYSTAL ARCHIVE and Type C Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art. KODAK DURATRANS, KODAK DURACLEAR, KODAK EKTAMAX RAL and KODAK DURAFLEX photographic materials, and KODAK Digital Paper Type 2976 are also typically processed as described above.

The following examples are intended to illustrate and not to limit the invention herein.

EXAMPLES

Example 1

Comparison

A photographic processing waste effluent was generated consisting of the following: 633 mL of Developer A and 367 mL of Bleach A. The effluent had a pH of 6.2. The corrosivity of low-carbon steel was measured by EPA method 1110A and found to be 13.0 mm/yr in one test and 14.1 mm/yr by a second test. The mixture is corrosive according to the RCRA regulation (greater than 6.35 mm/yr) and is, therefore, hazardous waste.

| Developer A | |
|---|---|
| Potassium Sulfite | 13.23 g/L |
| Sodium Bromide | 2.8 g/L |
| Hydroxylamine Sulfate | 3.0 g/L |
| Diethylenetriaminepentaacetic acid, pentasodium salt 40% w/w solution | 6.5 g/L |
| Potassium Iodide | 2.0 mg/L |
| Potassium Carbonate | 40.0 g/L |
| Potassium Bicarbonate | 2.32 g/L |
| Polyvinylpyrrolidinone, K-15 | 3.0 g/L |
| 4-amino-3-methyl-N-ethyl-(2-hydroxyethyl)aniline sulfate | 15.0 g/L |
| pH | 10.48 |

| Bleach A | |
|---|---|
| 1,3-Diaminopropanetetraacetic acid | 156.8 g/L |
| Succinic acid | 70.8 g/L |
| Ammonium Bromide | 60 g/L |
| Ferric Nitrate, 9 Hydrate | 188 g/L |
| Ammonium hydroxide and water to give a volume of 1 L and pH 4.00 | |

Example 2

A photographic processing waste effluent was generated consisting of the following: 790 mL of Developer A and 210 mL of Bleach A (compositions shown in Example 1, above). The effluent had a pH of 7.4. The corrosivity of low-carbon steel was measured by EPA method 1110A and found to be 5.7 mm/yr in one test and 4.9 mm/yr by a second test. The mixture is not corrosive according to the RCRA regulation (less than 6.35 mm/yr) and is, therefore, not hazardous waste by the corrosion regulation.

Example 3

Photographic waste effluent samples were generated, each consisting of 633 mL of Developer A and 367 mL of Bleach A (compositions shown in Example 1, above). Ammonium hydroxide or nitric acid was added to each mixture to bring the pH to the value shown in Table 1. The corrosivity of low-carbon steel was then measured by EPA method 1110A, and the results are shown in Table 1.

TABLE 1

| Sample | pH | Corrosion Measurement 1, mm/yr | Corrosion Measurement 2, mm/yr | Corrosion Measurement 3, mm/yr | Comment |
|---|---|---|---|---|---|
| 3A | 5 | 22.1 | 19.5 | 22.6 | Comparison |
| 3B | 6 | 16.3 | 13.6 | 16.7 | Comparison |
| 3C | 7 | 1.3 | 3.1 | 1.7 | Invention |
| 3D | 8 | 1.0 | 1.8 | 0.9 | Invention |

The mixtures with a pH of 7 or higher were found to be non-corrosive according to the RCRA regulation and are, therefore, not hazardous waste by this regulation.

Example 4

Photographic waste effluent samples were generated, each consisting of 42.7% by volume of Developer A (composition shown in Example 1, above), 28.6% by volume of Bleach B, and 28.6% by volume of Fixer A. The effluent samples also contained 0.0616 mol/L silver halide (3.5 mole % silver iodide and 96.5 mole % silver bromide) and 0.1% by volume KODAK Professional Photo-Flo 200 Solution (CAT No. 146 4510). Ammonium hydroxide or nitric acid was added to each mixture to bring the pH to the initial value shown in Table 2.

One liter of each effluent sample was added to 67 mL of a solution of 2,4,6-trimercapto-s-triazine, trisodium salt (TMT; 15% by weight in water) to precipitate the dissolved silver. The pH of the resulting mixtures increased due to the alkaline property of the TMT. The corrosivity of low-carbon steel was then measured by EPA method 1110A, and the results are shown in Table 2.

TABLE 2

| Sample | Initial pH | pH after addition to TMT | Corrosion Measurement 1, mm/yr | Corrosion Measurement 2, mm/yr | Comment |
|---|---|---|---|---|---|
| 4A | 6.01 | 6.82 | 5.34 | 4.85 | Invention |
| 4B | 5.57 | 6.03 | 6.43 | 6.56 | Comparison |
| 4C | 5.23 | 5.58 | 5.23 | 7.3 | Comparison |
| 4D | 4.82 | 5.04 | 7.58 | 10.88 | Comparison |

The mixture with a pH of 6.82 was found to be non-corrosive according to the RCRA regulation (6.35 mm/yr) and is, therefore, not hazardous waste by this regulation. The mixture with a pH of 6.03 is very nearly non-corrosive by this regulation. It can be seen that corrosivity of these effluent mixtures increases as the pH decreases.

Bleach B

| | |
|---|---|
| 1,3-Diaminopropanetetraacetic acid | 156.8 g/L |
| Succinic acid | 105 g/L |
| Ferric Nitrate, 9 Hydrate | 188 g/L |
| Ammonium hydroxide and water to give a volume of 1 L and pH 4.75 | |

Fixer A

| | |
|---|---|
| Ammonium Thiosulfate solution (56% w/w ammonium thiosulfate, 4% w/w ammonium sulfite) | 350 mL/L |
| Ammonium Sulfite monohydrate | 21.5 g/L |
| Ammonium hydroxide or succinic acid, and water to give a volume of 1 L and pH 7.9 | |

Example 5

Photographic waste effluent samples were generated, each consisting of 42.7% by volume of Developer A (composition shown in Example 1 above), 28.6% by volume of Bleach B (composition shown in Example 4), and 28.6% by volume of Fixer B. The effluent samples also contained 0.0616 mol/L silver halide (3.5 mole % silver iodide and 96.5 mole % silver bromide) and 0.1% by volume KODAK Professional Photo-Flo 200 Solution (CAT No. 146 4510). Ammonium hydroxide or nitric acid was added to each mixture to bring the pH to the initial value shown in Table 3.

One liter of each effluent sample was added to 67 mL of a solution of 2,4,6-trimercapto-s-triazine, trisodium salt (TMT; 15% by weight in water) to precipitate the dissolved silver. The pH of the resulting mixtures increased due to the alkaline property of the TMT. The corrosivity of low-carbon steel was then measured by EPA method 1110A, and the results are shown in Table 3.

Fixer B

| | |
|---|---|
| Ammonium Thiosulfate solution (56% w/w ammonium thiosulfate, 4% w/w ammonium sulfite) | 690 mL/L |
| Ammonium hydroxide or succinic acid, and water to give a volume of 1 L and pH 7.9 | |

TABLE 3

| Sample | Initial pH | pH after TMT addition | Corrosion Measurement 1, mm/yr | Corrosion Measurement 2, mm/yr | Comment |
|---|---|---|---|---|---|
| 5A | 6.02 | 6.60 | 5.74 | 5.12 | Invention |
| 5B | 5.60 | 6.07 | 7.52 | 9.04 | Comparison |
| 5C | 5.18 | 5.48 | 7.76 | 8.39 | Comparison |
| 5D | 4.74 | 4.95 | 8.51 | 10.35 | Comparison |

The mixture with a pH of 6.60 was found to be non-corrosive according to the RCRA regulation (6.35 mm/yr) and is, therefore, not hazardous waste by this regulation. The mixture with a pH of 6.07 is very nearly non-corrosive by this regulation. The corrosivity increases as the pH decreases.

Example 6

Four photographic waste effluent solutions were generated, each consisting of Developer B, Bleach C, Fixer C, and Rinse A. The volume percent of the developer, bleach, fixer, and rinse are given in Table 4. The effluent solutions also contained silver iodide and silver bromide in the amounts shown in Table 4 and 0.5 mL KODAK Professional Photo-Flo 200 Solution (CAT No. 146 4510) per liter of waste effluent.

One liter of each effluent solution was added to a solution (volume shown in Table 4) of 2,4,6-trimercapto-s-triazine, trisodium salt (TMT; 15% by weight in water) to precipitate the dissolved silver. The pH of the resulting mixtures was adjusted to 7.5. The corrosivity of low-carbon steel was then measured by EPA method 1110A and the results are shown in Table 5. The corrosion measurements are all less than 6.35 mm/yr. Therefore, the samples are non-corrosive wastes according to the RCRA corrosion regulation.

TABLE 4

| Sample | Developer B, vol % | Bleach C, vol % | Fixer F, vol % | Rinse A, vol % | AgI, g/L | AgBr, g/L | TMT Solution, mL/L |
|---|---|---|---|---|---|---|---|
| 6A | 20.7 | 13.8 | 10.4 | 55.1 | 0.24 | 5.42 | 32.4 |
| 6B | 19.4 | 19.4 | 9.7 | 51.5 | 0.23 | 5.07 | 30.3 |
| 6C | 18.2 | 18.2 | 15.2 | 48.4 | 0.22 | 4.76 | 28.5 |
| 6D | 28.6 | 17.2 | 8.6 | 45.6 | 0.21 | 4.49 | 26.9 |

TABLE 5

| Sample | pH | Corrosion Measurement 1, mm/yr | Corrosion Measurement 2, mm/yr | Comment |
|---|---|---|---|---|
| 6A | 7.5 | 4.5 | 4.8 | Invention |
| 6B | 7.5 | 4.9 | 5.8 | Invention |
| 6C | 7.5 | 5.6 | 5.9 | Invention |
| 6D | 7.5 | 6.0 | 5.8 | Invention |

| Developer B | |
|---|---|
| Sodium Sulfite, anhydrous | 6.0 g/L |
| Sodium Bromide | 2.1 g/L |
| Sodium Carbonate, anhydrous | 26.9 g/L |

-continued

| Developer B | |
|---|---|
| 4-amino-3-methyl-N-ethyl-(2-hydroxyethyl)aniline sulfate | 6.75 g/L |
| pH | 10.1 |

| Bleach C | |
|---|---|
| 1,3-Diaminopropanetetraacetic acid | 156.8 g/L |
| Succinic acid | 50 g/L |
| Ferric Nitrate, 9 Hydrate | 188 g/L |
| Ammonium hydroxide and water to give a volume of 1 L and pH 3.5 | |

| Fixer C | |
|---|---|
| Ammonium Thiosulfate solution (56% w/w ammonium thiosulfate, 4% w/w ammonium sulfite) | 525 mL/L |
| Sodium Metabisulfite | 7.8 g/L |

-continued

| Fixer C | |
|---|---|
| Succinic acid | 12 g/L |
| Water to give a volume of 1 L and pH of 5.75 (adjust with succinic acid) | |

Rinse A 9 mL KODAK Flexicolor Final Rinse and Replenisher (CAT No. 848 6268) dissolved in 991 mL water.

The invention has been described in detail with particular reference to certain preferred embodiments thereof, but it will be understood that variations and modifications can be effected within the spirit and scope of the invention.

What is claimed is:

1. A method of photographic processing and management of photographic processing solutions comprising:

A) color developing an imagewise exposed color photographic silver halide material with an aqueous color developing composition comprising a color developing agent, B) without removing said color photographic silver halide material from said aqueous color developing composition, contacting said color photographic silver halide material with a photographic fixing composition comprising a photographic fixing agent, thereby forming a combined color development/fixing processing composition, C) without removing said color photographic silver halide material form said combined color development/fixing processing composition, contacting said color photographic silver halide material with a photographic bleaching composition, thereby forming a combined color development/fixing/bleaching processing composition, and D) delivering the combined color development/fixing/bleaching processing composition to a collection vessel to form a used photographic processing composition.

2. The method of claim 1 wherein the combined color development/fixing/bleaching processing composition has a pH of 6.5 to 11.

3. The method of claim 1 further comprising using a chemical treatment to adjust the pH of the combined color development/fixing/bleaching processing composition or the used photographic processing composition to 6.5 to 11.

4. The method of claim 3 wherein the used photographic processing composition is treated with a chemical acid or base to adjust the pH to 6.5 to 11.

5. The method of claim 1 wherein the pH of the combined color development/fixing/bleaching processing composition is 7.0 to 9.0.

6. The method of claim 2 wherein the pH of the combined color development/fixing/bleaching processing composition or the used photographic processing composition is adjusted to 7.0 to 9.0.

7. The method of claim 1 wherein said used photographic processing composition is treated with a silver precipitating agent.

8. The method of claim 3 wherein said used photographic processing composition is treated with a silver precipitating agent.

* * * * *